United States Patent [19]

Claudet et al.

[11] Patent Number: 4,840,032

[45] Date of Patent: Jun. 20, 1989

[54] REFRIGERATOR, MORE PARTICULARLY WITH VUILLEUMIER CYCLE, COMPRISING PISTONS SUSPENDED BY GAS BEARINGS

[75] Inventors: Gérard Claudet, La Tronche; Bernard Dewanckel; Alain Ravex, both of Meylan; Serge Reale, Grenoble, all of France

[73] Assignees: Commissariat a l'Energie Atomique; Air Liquid, both of Paris, France

[21] Appl. No.: 150,971

[22] Filed: Feb. 1, 1988

[30] Foreign Application Priority Data

Feb. 16, 1987 [FR] France ..... 87 01926

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,292,501 | 12/1966 | Verbeek . | |
| 3,774,405 | 11/1973 | Leo | 62/6 |
| 4,389,849 | 6/1983 | Gasser et al. | 62/6 |
| 4,429,539 | 2/1984 | Leach | 62/6 |
| 4,459,811 | 7/1984 | Barclay et al. | 62/6 X |
| 4,500,265 | 2/1985 | Evans et al. | 62/6 X |
| 4,522,032 | 6/1985 | Nakamura | 62/6 |
| 4,545,209 | 10/1965 | Young | 62/6 |
| 4,584,839 | 4/1966 | Jensen et al. | 62/6 |
| 4,606,194 | 8/1986 | Pirtle et al. | 62/6 |
| 4,610,143 | 9/1966 | Stolfi et al. | 62/6 |

FOREIGN PATENT DOCUMENTS

| | | |
|---|---|---|
| 76726 | 4/1983 | European Pat. Off. . |
| 114069 | 7/1984 | European Pat. Off. . |
| 2251189 | 3/1985 | France . |

*Primary Examiner*—Ronald C. Capossela
*Attorney, Agent, or Firm*—James E. Nilles

[57] ABSTRACT

It comprises a first cylinder (102), a displacement piston (104) sliding in the first cylinder (102), a conduit in which a thermal regenerator is included, a second cylinder (202), a second displacement piston (204) sliding in the second cylinder (202), means for displacing the first cylinder and the second cylinder in phase relation. A gas bearing (104*a*) is provided at the hot end of the first piston (104) and a gas bearing (104*b*) is provided at the intermediate temperature end of the first piston. A gas bearing (204*b*) is also provided at the intermediate temperature end of the second piston (204) and a gas bearing (204*a*) is provided at the cold end of the second piston (204).

15 Claims, 5 Drawing Sheets

Figure 4:
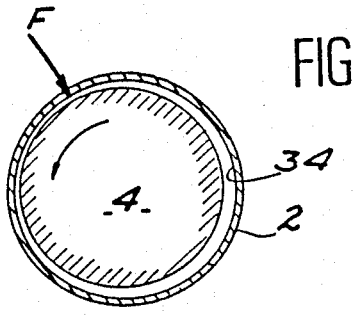

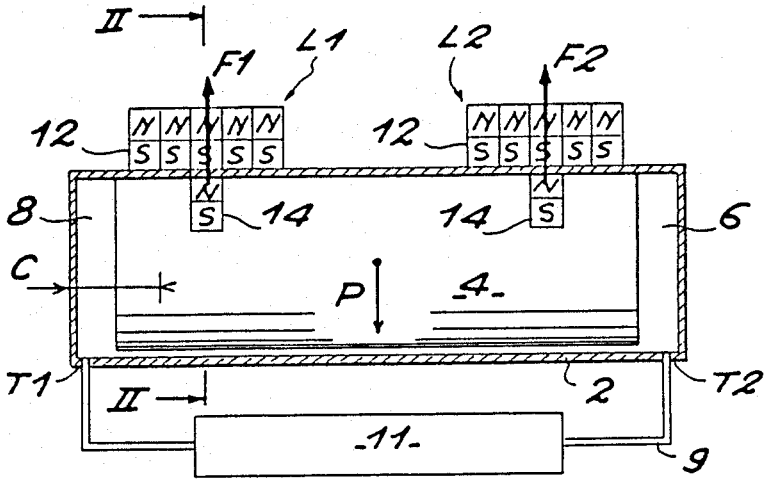
FIG. 1
FIG. 2
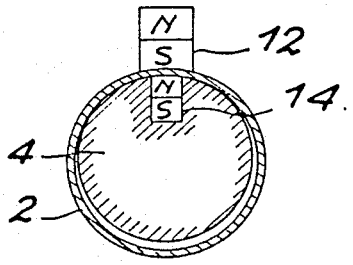
FIG. 3
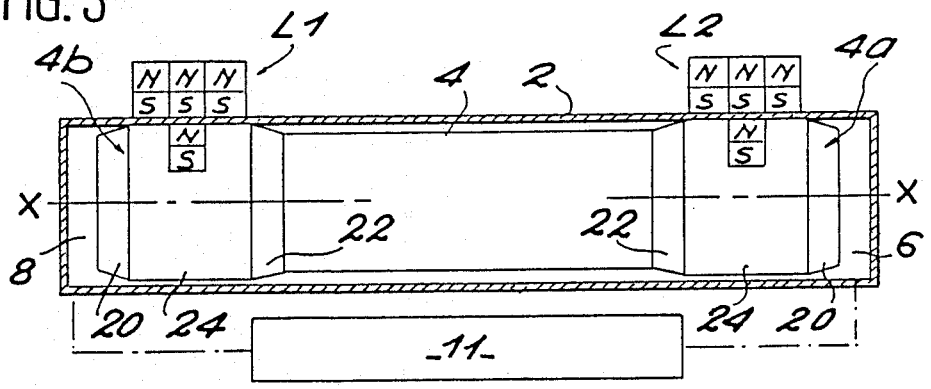

REFRIGERATOR, MORE PARTICULARLY WITH VUILLEUMIER CYCLE, COMPRISING PISTONS SUSPENDED BY GAS BEARINGS

The invention relates to a low power cryogenic refrigerator, more particularly a refrigerator operating by the Vuilleumier cycle.

More precisely the invention relates to a refrigerator capable of operating for a very long period without the possibility of intervention or maintenance, so that it can be used, for example, on board a satellite.

Low power cryogenic refrigeration—i.e., for powers between one tenth of a watt and several watts, at temperature levels between 100K and 4K is obtained in known manner by machines operating by the Stirling, Mac Mahon, Vuilleumier cycles or their derivatives.

In a general way, refrigerators of this kind comprise one or more cylinders in each of which a piston slides which is driven with a reciprocating traversing movement to compress or expand a gas, or simply to transfer such gas from one chamber to another.

These pistons are called "compressors" when a force must be applied to the piston to overcome the forces due to the different pressures on its two surfaces. Compressor-type pistons are used for mechanically compressing (or expanding) gas in Stirling, Gifford, Mac Mahon, Joule, Thomson cycles, or their derivatives. In practice the forces applied to the pistons either by the gas or by the mechanical force of the driving motor are never strictly axially and opposite, this causes considerable radial reactions on the gas bearings, which must therefore be designed to withstand considerable forces and which must therefore be highly rigid.

In contrast, the pistons are called "displacement" pistons when they merely perform constant volume conversions by transferring a quantity of gas from one chamber at a certain temperature to another chamber at a different temperature. Such an operation takes the form of a change in the gas pressure (compression or expansion, in dependence on direction), but with the special feature that the same pressure in maintained on the two faces of the piston at all times. Such compression does not consume mechanical energy, except for frictional losses or flow losses of load. It merely consumes thermal energy to maintain the chambers at different temperatures.

In that kind of conversion (compression or expansion) which could be called thermodynamic, the displacement piston is subjected to no other forces than its weight or its inertia, or friction and pressure differences, which can be made very low. As a result the load on the bearings can be considerably reduced. The Vuilleumier cycle has the special feature that it can be put into effect with the exclusive use of displacement pistons. It is a cycle with three sources of temperature which is familiar to engineers in the art and was described, for example, in the paper by F. F. Chellis and W. H. Hogan, entitled: "A liquid nitrogen operated refrigerator for temperatures below 77K", published in "Advances in Cryogenic Engineering", vol. 9, 1963, pp 545–551.

The refrigerator according to the invention therefore uses the Vuilleumier cycle, which enables machines to be produced in which the piston guide bearings, forming one of the critical elements conditioning the service life of the refrigerator, are subjected only to very low forces and therefore cause little wear or heat generation. This feature forms a considerable advantage over machines operating by other cycles and using compressor pistons, since in the latter case the bearings of the pistons are heavily loaded. There is considerable wear and heat generation, so that it is very difficult to produce machines having a long service life.

When service life of several years must be attained, for applications in space, for example, it becomes necessary to use bearings with no contact—i.e., without wear.

Machines are known which operate by a Vuilleumier cycle and use solid/solid contact bearings, but bearings of that kind are unacceptable for operating several years without maintenance.

Machines are also known which operate by a Stirling cycle and comprise active magnetic suspension pistons (L. Knox, P. Patt, R. Maresca, "Design of a flight qualified long life cryocooler", in "Proceedings of the Third Cryocooler Conference", NBS Special Publication No. 698, May 1985, pp 99–118). The technology of the active magnetic bearing consists in controlling the position of a piston by means of electromagnets which are disposed on its periphery and energized to a varying extent in dependence on the clearance between the piston and the cylinder, the clearance being measured at different points. Measurement of the clearances and controlling the position of the piston require highly complex electronic circuits, since the linear displacement means may introduce highly harmful magnetic disturbances. Moreover, the electromagnets give off heat by Joule effect. This contribution of heat is a very considerable disadvantage, since it prevents the use of such bearings in those parts of the refrigerator in which a cryogenic temperature is to be maintained (i.e., a very low temperature, of the the order of a few K to one hundred K). The prior art (S. T. Werret, G. D. Peskett, G. Davey, T. W. Bradshaw, J. Delderfield, "Development of a small Stirling cycle cooler for spaceflight applications", in "Advances in Cryogenic Engineering", vol. 31, 1986, pp 791–809) also discloses refrigerators in which the pistons are suspended by a set of membranes which can readily be deformed in the direction of axial movement, but are fairly rigid radially, to prevent contact between the moving members.

However, the alternate deformation of the membranes inevitably causes a risk of degradation which is difficult to control. Moreover the use of a membrane implies stresses of a geometric order which limit its use.

Low deformation of the membranes is possible only with short travels. Moreover, a small clearance between the piston and the cylinder can be obtained only with membranes of small diameter.

The invention relates precisely to a refrigerator, more particularly a refrigerator operating by the Vuilleumier cycle, which obviates these disadvantages. The refrigerator must be able to operate for a number of years without any maintenance on the bearings supporting the pistons. Consequently, the bearings must be subjected to very little loading. They must not be subject to wear or give off heat.

To this end the invention relates to a refrigerator which operates by a Vuilleumier cycle and is characterized in that it uses at least one gas bearing for the suspension of at least one piston.

As a result of these features the refrigerator according to the invention is suitable for applications in space, where the refrigerator is not subject to the force of gravity.

Preferably the refrigerator comprises:

a first cylinder having a hot end and an intermediate temperature end, and displacement piston sliding in the first cylinder between a first and a second position to compress and expand a quantity of gas contained in the first cylinder, a conduit which includes a thermal regenerator connecting the high temperature end and the intermediate temperature end of the first cylinder;

a second cylinder having an intermediate temperature end and a cold end, a second displacement piston sliding in the second cylinder between a first and a second position to compress and expand a quantity of gas contained in the second cylinder;

a duct connecting the intermediate temperature end of the first cylinder and the intermediate temperature end of the second cylinder;

means for displacing the first cylinder and the second cylinder in phase relation.

It is characterized in that it comprises:

a gas bearing at the hot end of the first piston and a gas bearing at the intermediate temperature end of the first piston;

a gas bearing at the intermediate temperature end of the second piston and a gas bearing at the cold end of the second piston.

In a preferred embodiment the refrigerator according to the invention comprises two pistons so operating in phase opposition as to minimize vibrations.

When the refrigerator operates on Earth, and is therefore subjected to the force of gravity, or when it is on board a spinning satellite (rotating around its longitudinal axis), extra means must be provided for supporting the pistons. To this end the refrigerator comprises:

at least one series of magnets disposed along the upper generatrix of the first cylinder, such series of magnets having a length greater than the distance between the first and second positions of the first piston, a permanent magnet being mounted on the first cylinder opposite each of the series of magnets; and at least one series of magnets disposed along the upper generatrix of the second cylinder, such series of magnets having a length greater than the distance between the first and second positions of the second piston of the second cylinder, a magnet being mounted on the second cylinder opposite each of the series of magnets of the second cylinder.

Figure 5A:
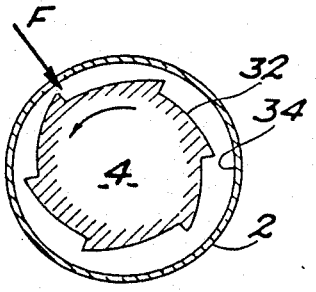
Figure 5B:
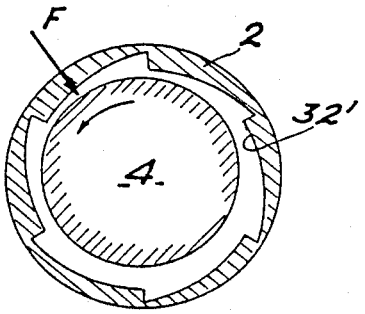
Figure 6:
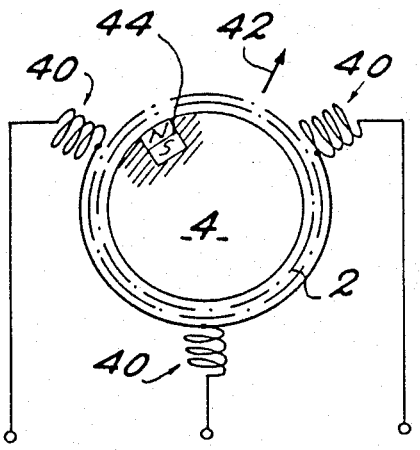
Figure 7:
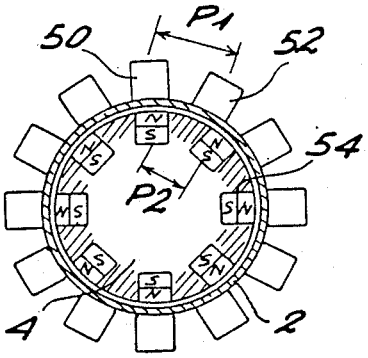

Other features and advantages of the invention will be gathered from the following description of illustrative, non-limitative embodiments thereof, with reference to the accompanying drawings, wherein:

FIG. 1 is a diagrammatic longitudinal sectional view illustrating the principle of suspension of a displacement piston according to the invention, FIG. 2 is a view in cross-section taken along the line II—II in FIG. 1, FIG. 3 is a diagrammatic view illustrating a first embodiment of a gas bearing according to the invention, FIG. 4 is a cross-sectional view illustrating a rotary gas bearing according to a second embodiment of the invention, FIGS. 5*a* and 5*b* are cross-sectional views illustrating two variant embodiments of a rotary gas bearing illustrated in FIG. 4, FIG. 6 illustrates a first means for rotating a piston in the case of a gas bearing of the kind described with reference to FIGS. 4 or 5, FIG. 7 illustrates a second means of rotating the piston.

Figure 8A:
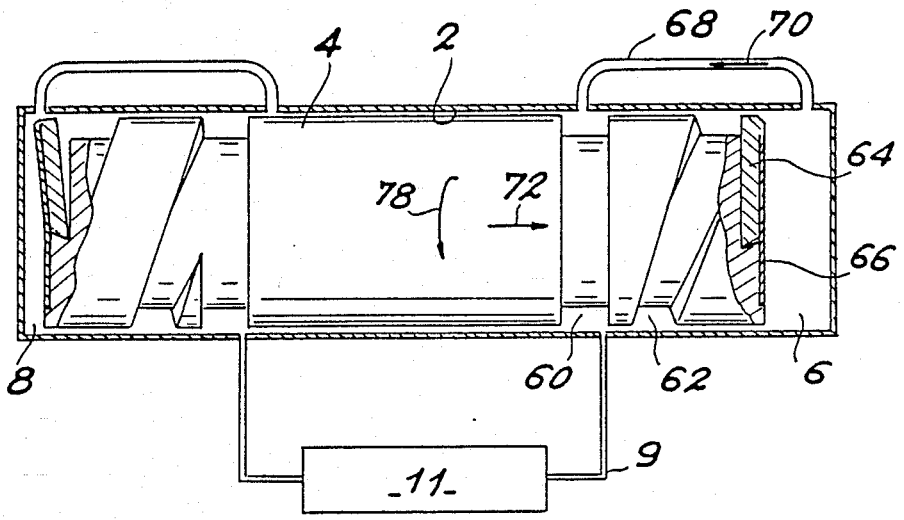
Figure 8B:
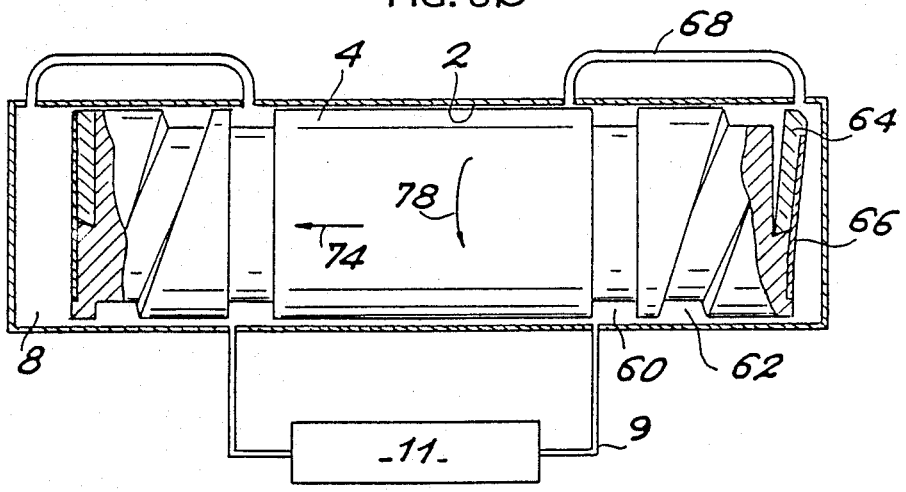
Figure 9:
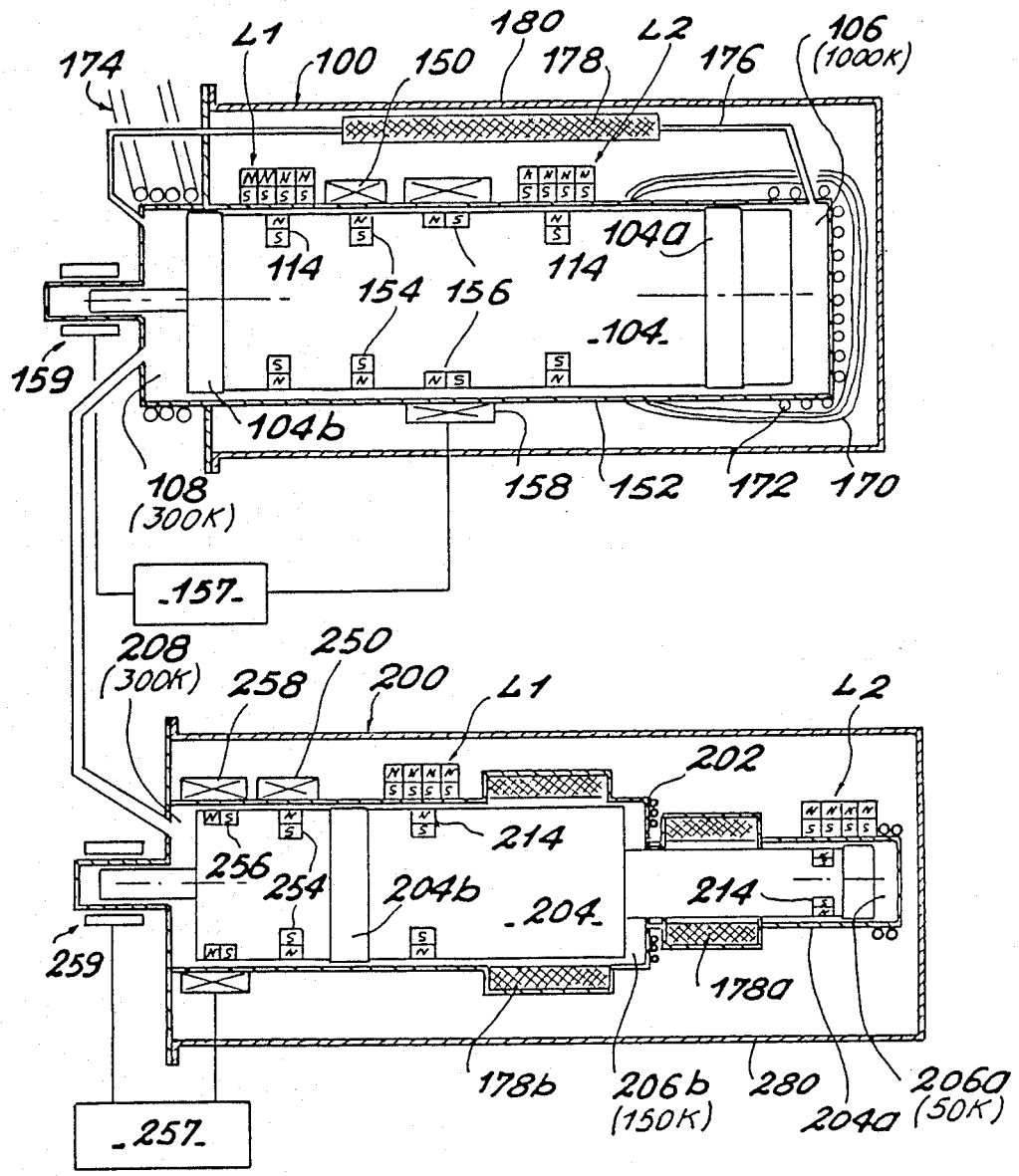

FIGS. 8*a* and 8*b* illustrate a third embodiment enabling a displacement piston to be rotatably driven, and FIG. 9 illustrates a complete construction of a cryogenic refrigerator according to the invention.

Figure 10:
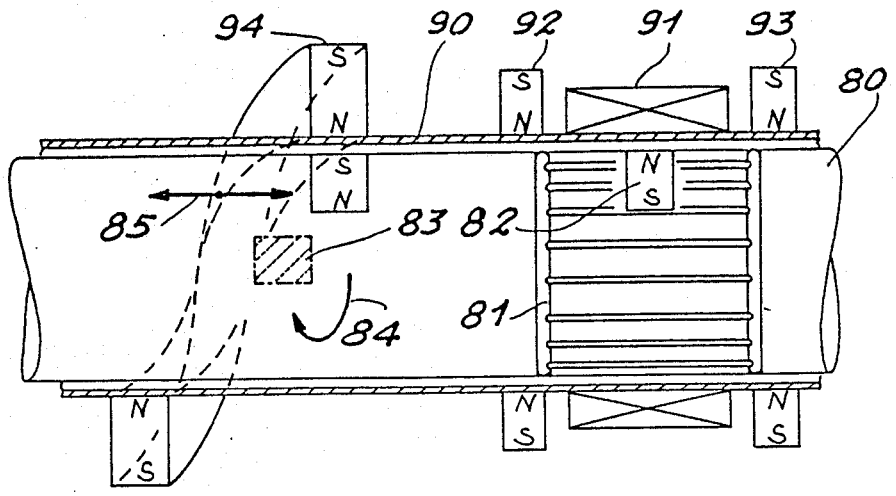

FIG. 10 represents a constructional variant of the means permitting the driving of the piston in alternating translation.

FIGS. 11*a, b, c*, a detail showing three possible forms of the magnetized ramp forming part of the construction of FIG. 10.

FIG. 1 is a diagrammatic longitudinal sectional view of a cylinder 2 forming part of a cryogenic refrigerator operating by a Vuilleumier cycle. A displacement piston 4 is given a reciprocating traversing movement inside the cylinder 2, so as to transfer a quantity of cycle gas from a first hermetic chamber 6 to a second hermetic chamber 8 via a duct 9. In a general way, a Vuilleumier cycle refrigerator comprises at least two piston-and-cylinder assemblies, the first of the assemblies forming a thermal compressor and the second a cold finger. However, the refrigerator need not be illustrated in full in order to explain the principle of the invention.

The displacement piston has a mass M corresponding to a weight P under the effect of a given acceleration, for example, the acceleration of the Earth's gravity. A line of magnets L1 and line of magnets L2 are disposed along an upper generatrix of the cylinder 2. The lengths of the lines are equal or not, but in all cases greater than the reciprocating travel C of the piston. In the embodiment illustrated the lines L1 and L2 are made up of five magnets disposed side by side. The magnets 14 are mounted on a displacement piston 4 opposite the line of magnets L1 and the line of magnets L2 respectively. The weight P of the displacement piston is balanced by the assembly of permanent magnets acting by attraction and producing forces F1 and F2 in dependent of the axial position of the piston, given that the lines of magnets L1 and L2 and a length greater than the travel C.

The forces of attraction in the magnets are so selected that the sum of the forces F1 and F2 is slightly less than the weight P of the piston 4, to prevent the magnets from sticking. The resulting force to be withstood is equal to $P-(F1+F2)$. This resulting force can be readily reduced to a low fraction of P, for example, a few %. The forces P, F1 and F2 are disposed in the same plane, so that no lateral reaction is introduced.

In the particular case of applications in space, the absence of gravity makes the compensation of weight by means of magnets pointless.

However, certain so-called "spinning" satellites are rotated around their axis. In that case it remains necessary to equilibrate the centrifugal force. According to another feature of the invention, a gas bearing is produced by a relative movement of the displacement piston 2 in relation to the cylinder 4, so as to obtain a centring effect which is added to the suspension by the permanent magnets to obtain the frictionless guiding of the piston. Of course, when the refrigerator is not subject to gravity, the gas bearings alone are adequate to ensure the frictionless guiding of the piston, without the need to provide passive magnetic suspension by permanent magnets.

FIG. 3 shows a first embodiment of a gas bearing according to the invention. The piston 4 has a first end 4*a*, for example, on the side of the hot chamber of the cylinder 2, and an end 4*b*, for example, on the side of the end of the cold chamber of the cylinder 2. A gas bearing is provided at each of the ends 4*a*, 4*b*. The bearings are formed by two conical surfaces 20 and 22 respectively, which are opposed by their bases and separated by a cylindrical surface of constant section 24. A small clearance (a few microns) is left between the external surface 24 of the piston 4 and the internal peripheral wall of the cylinder 2. When the piston is given a reciprocating traversing movement, the gas contained in the chambers 6 and 8 respectively forms a wedge between the internal wall of the cylinder 2 and each of the conical walls 20 and 22, in dependence on the direction of movement. The hydrodynamic forces thus produced exert a force on the piston which centres the piston in relation to the axis XX of the cylinder 2.

Since the essential proportion of the weight P of the piston is supported by the lines of magnets L1 and L2, as explained with reference to FIGS. 1 and 2, the production of the gas bearing does not require the traversing speeds to be high. As a result, the obtaining of these low speeds causes no difficult technological problem.

If the refrigerator is not subject to gravity, there is no need to provide the lines of permanent magnets L1 and L2. In that case the piston 4 is supported exclusively by the gas bearings disposed at each of its ends.

FIGS. 4 and 5 show a second embodiment of gas bearings according to the invention. The second embodiment is characterized in that the gas bearing is obtained by the piston 4 rotating on itself, instead of a reciprocating traversing movement, as in the embodiment illustrated in FIG. 3. In the variant illustrated in FIG. 4 the relative rotary movement of the piston 4 in relation to the cylinder 2 entrains the cycle gas by viscosity, the effect being to form a wedge which produces a recentring force F of the piston 4 in relation to the cylinder 2. Preferably a bearing of this kind is provided at each of the ends of the piston 4.

FIGS. 5*a* and 5*b* show two variant embodiments of a rotary gas bearing according to the invention. The principle of the bearing is identical with that of FIG. 4, but the piston 4 comprises (FIG. 5*a*) a series of ramps 32, five in the example selected, whose convex section is inclined in relation to the internal surface 34 of the cylinder 2, so as to define with such cylinder a clearance which progressively diminishes from the start to the end of the ramp 32. The supporting effect by a wedge of gas entrained by viscosity, described with reference to FIG. 4, is therefore obtained several times per revolution, five times in the example illustrated.

It is also possible (FIG. 5*b*) to use a circular piston in a chamber, comprising multiple ramps 32'.

In a manner similar to the first embodiment, the gas bearings in FIGS. 4, 5*a* and 5*b* can be used on their own—i.e. in the absence of passive magnetic suspension by permanent magnets, when the refrigerator is not subject to the force of gravity during its operation.

The nature of the materials from which the gas bearing is obtained—i.e. the material of the piston 4 and that of the cylinder 2, is a matter of indifference, but materials having good frictional properties and a low frictional coefficient and low wear are preferable in case of accidental contact or during launching periods. Use can be made of metals or metallic alloys, and also plastics. However, preferably use will be made of ceramic materials such as alumina and zirconium, which allow superior performances, more particularly for operation at elevated temperatures.

FIG. 6 shows a first embodiment of a means for rotatably driving the piston 4 so as to produce a rotary gas bearing such as that shown in FIGS. 4 and 5. In the example illustrated in FIG. 6, disposed around the cylinder 2 are three coils 40, at 120° from one another, each of the coils being supplied with one phase of a triple-phase electric current. In a manner known in electrical engineering, the flow of current produces a rotary magnetic field, symbolized by arrow 42, whose period of rotation is equal to that of the current. A permanent magnet 44 is provided on the piston 4. The magnet is driven synchronously by the rotary field. The result is a synchronous motor which enables the piston 4 to be rotatably driven at the required speed. An asynchrous motor might also be produced by substituting ferromagnetic materials for the permanent magnet 44. Instead of a triple phase current, one could use a single phase alternating current for producing a synchronous or a asynchronous motor.

FIG. 7 shows another means of rotatably driving the piston 4. Two coils 50 and 52 spaced out by a pitch P1 are provided on the periphery of the cylinder 2. A plurality of magnets 54 spaced out by a pitch P2 smaller than the pitch P1 are regularly distributed on the periphery of the piston 4. In known manner, the coil 50 and the coil 52 are supplied alternately. Under the effect of the electromagnetic forces appearing, one of the magnets 54 takes up position opposite the coil supplied. When the supply is cut from that coil to supply the other coil, an adjacent magnet 54 takes up position opposite the second coil. The piston is therefore rotatably driven by a series of successive pulses producing displacements by increments. Of course, a large number of variants of such stepping motors exist, which are moreover known in the prior art, and the example in FIG. 7 is given merely by way of illustration. Clearly, other means than those disclosed with reference to FIGS. 6 and 7 might be used to rotatably drive the piston.

FIGS. 8*a* and 8*b* show a third means of rotatably driving the piston 4. At one or each of its ends the piston 4 comprises a chamber 60 bounded by a circular groove. The width of the groove is at least equal to the reciprocating travel C of the piston. A helical groove 62 discharges at one of its ends into the chamber 60 and at its other end into the chamber 6 and/or the chamber 8.

A non-return valve formed, for example, by a plate 64 which blocks the end of the helical groove 62 discharging into the chamber 6 and the chamber 8; the plate 64 being supported by a flexible strip 66, prevents the cycle gas from passing directly from chamber 6 and chamber 8 into the helical groove 62. The gas must therefore flow via a shunt conduit 68.

When the piston 4 moves from left to right, in the direction indicated by arrow 72 in FIG. 8*a*, the gas present in the chamber 6 is transferred via the shunt conduit 68 to the circular groove 60, as indicated by arrow 70.

On the other hand, when the piston 4 moves from right to left, as shown in FIG. 8*b* (arrow 74), the valve 64, 66 is open and the action of the gas on the walls of the helical groove 62 rotatably drives the piston 4 in the direction indicated by arrow 78. This embodiment is particularly advantageous, since it requires no electrical mechanical device to rotatably drive the piston. Moreover, this means is enough to obtain the low speed of rotation of the piston, about 5 revolutions per second, required to support the piston.

The rotational movement of the piston obtained by any of the means described hereinbefore and which makes it possible to create the support effect by hydrodynamic gas bearings can also be used for inducing the alternating translation movement producing the displacement of the gas necessary for producing the desired thermodynamic cycle.

FIG. 10 shows a means making it possible to obtain a mixed rotary and translational movement by contactless action of an elliptical magnetic ramp 94*a*.

A piston 80 located within a cylinder 90 is rotated by a synchronized asynchronous motor having coils 91 producing a rotary radial field, a squirrel cage 81 ensuring the asynchronous rotation, particularly on starting, as well as a magnet 82 ensuring the synchronous rotation of piston 80.

The thus produced rotary movement moves the magnet 83, integral with piston 80 in front of the magnetic ramp 94, which leads to an attraction of magnet 83. The magnetized ramp has an elliptical geometry inclined in the longitudinal axial direction of piston 80. It produces an axial force tending to maintain magnet 83 in the maximum field of elliptical ramp 94. This leads to an alternating translational movement indicated by arrow 85, whereof it is possible to control the end of travel parts by magnetized rings 93,94 operating in repulsion on magnet 82 and acting as springs.

In the case of FIG. 10 having an elliptical ring 94, the combined rotary and translational movements of piston 80 take place at the same frequency. In other words, piston 80 performs an alternating outward and return travel at the same time as it performs a complete rotation about its longitudinal axis.

It is also possible to use a ring with a matched shape making it possible to control at all points the accelerations imparted to the translational movement in order to obtain a sinusoidal movement, which is deformed to a greater or lesser extent as a function of requirements.

Figure 11:
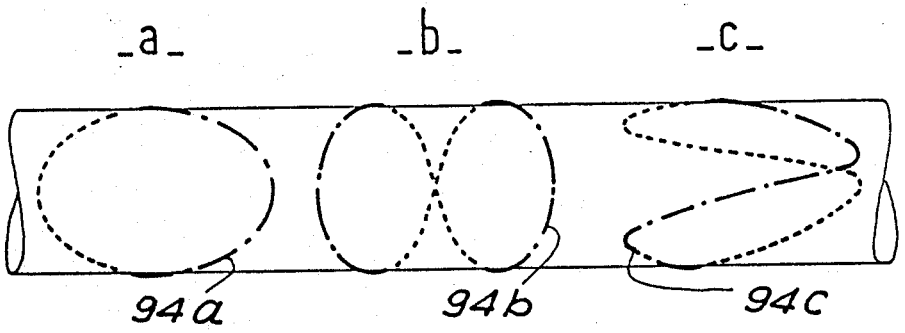

FIG. 11 shows three different embodiments of the magnetized ramp 94, which was described hereinbefore. It is shown again only to give a reminder so as to permit comparison with shapes 94*b* and 94*c*. The magnetized ramp 94*b* has two helical turns of opposite pitches in order to obtain a rotary frequency of piston 80 which is double its translational frequency. It is obvious that it would also be possible to use several helical turns of opposite pitches in order to obtain a rotary frequency which is a multiple of the translational frequency.

Conversely, FIG. 11*c* shows a magnetized ramp 94*c* having two undulations per revolution, which makes it possible to create a translation with the double frequency of the rotary frequency of piston 80. Obviously there could be three, four or more undulations per revolution in order to obtain a translation with triple, quadruple or multiple the frequency of the rotary frequency.

FIG. 9 shows a complete embodiment of a refrigerator according to the invention operating by a Vuilluemier cycle. The refrigerator is made up of two assemblies—i.e., a thermal compressor 100 and an expander 200, also referred to as a cold finger hereinafter.

The thermal compressor 100 comprises a piston 104 sliding inside a cylinder 102 of diameter 55 mm and length 300 mm containing gaseous helium whose pressure vary between about 5 and 10 bar. The piston 104 bounds a hot chamber 106 and a cold chamber 108 at each of the opposite ends of the piston 104. A bearing 104*a* is provided at the hot end of the piston, while a cold bearing 104*b* is provided at the cold end of the piston. In the embodiment disclosed the bearings 104*a* and 104*b* are rotary-type gas bearings such as, for example, those illustrated in FIGS. 4 and 5 of the Application. They are formed by two alumima rings having a radial clearance of 20 microns.

In addition two suspension lines L1 and L2, formed by a series of permanent magnets disposed along an upper generatrix of the cylinder 102, co-operating with permanent magnets 114, 114 enable the weight P of the piston 104 to be equilibrated. In this example two lines L1 and L2 are used, but a single line might also be used, on condition that it was disposed symmetrically in relatio to the centre of gravity of the piston and was at least as long as the travel C of the piston.

As disclosed hereinbefore, means but be provided for rotatably driving the piston 104 in relation to the cylinder 102 so as to form at least one cycle fluid wedge allowing a support of the piston 104 complementary to the equilibration of the weight. In the example illustrated in FIG. 9 the piston 104 is rotatably driven at a speed of 5 revolutions per second by a stepping motor such as, for example, that illustrated in FIG. 7, formed by two coils, only one of which, coil 150 is shown in FIG. 9, and a plurality of magnets 154 distributed along the circumference of the piston 104.

Means are also provided for producing a reciprocating traversing movement of 20 mm of the piston 104. The means are formed in the example selected by a linear stepping motor formed on the one hand by a series of permanent magnets 156 distributed along a circumference of the piston 104, and on the other hand coils 158 disposed opposite the magnets 156. The operating principle of the linear stepping motor is identical with that of the rotary motor and will therefore not be described in detail.

The supply of electric power to the coils of the linear motor is controlled by control device 157 which receives indications from a position detector 159 enabling the position of the piston 104 in relation to the cylinder 102 to be detected.

The thermal compressor 100 also comprises a number of layers of insulating material 170 enclosing its hot end and an electric heating resistor 172 enabling the hot end to be maintained at a temperature of the order of 1000K. Other means, such as solar or nuclear heating might be suitable.

Conversely, the cold chamber 108 is cooled by a cooling circuit 174 which enables its temperature to be maintained at about 300K. The chambers 106 and 108 are interconnected via a duct 176 including a known thermal regenerator 178.

The hot part of the cylinder is enclosed in a chamber 180 forming a vacuum enclosure containing a high vacuum, so as to prevent heat losses to the outside.

The refrigerator shown in FIG. 9 also comprises a cold finger 200. Its composition is essentially identical with that of the thermal compressor 100. It comprises two permanent magnet equilibration bearings enabling the weight of the piston 204 to be equilibrated. The bearings have the reference 214. It also comprises a stepping motor 250, 254 for rotatably driving the piston 204 and a stepping motor 256, 258 for driving the piston with a reciprocating traversing movement (travel 10 mm). As disclosed hereinbefore, a control device 257 which receives information from a known position detector 259 controls the supply of electric power to the coils 258 of the linear stepping motor. The piston 204 also comprises a cold bearing 204*a* situated on the right in the drawing and a hot bearing 204 situated on the left in the drawing. The production of these bearings is identical with what was disclosed hereinbefore. However, note should be taken of a special feature of the piston 204, which is stepped so as to bound not only one chamber, but two chambers 206*a* and 206*b*. Its length is 200 mm and its diameter 40 mm between the chamber 208 at 300K and the chamber 206*b* at 105K. Its. length is 100 mm and its diameter 15 mm between the chamber 206*b* and the chamber 206*a* at 50K. The refrigerator therefore enables heat to be extracted at two different temperatures, 1 watt at 50K in the chamber 206*a* and 3 watts at 150K in the chamber 206*b*.

The thermal regenerators are also different. While in the case of the thermal compressor 100 the thermal regenerator 178 was physically separated from the enclosure bounded by the cylinder 102, in the case of the cold finger 200 the thermal regenerators 178*a* and 178*b* are formed by a lining material which lines the bottom of the circular grooves with which the wall of the cylinder 202 is formed.

Lastly, the cold finger assembly is contained in an enclosure 280 in which there is a vacuum, to reduce contributions of heat coming from outside to the mimimum.

Other embodiments might be conceived without exceeding the scope of the invention. For each of the parts—i.e., for the thermal compressor 100 and the cold finger 200—two pistons might be provided operating in phase opposition, to reduce vibration to the minimum. Different values of temperature and power might be provided at the different stages, and also different electric or pneumatic means for producing a traversing or rotary movement. The gas bearings might be differently designed or arranged and the elements might be differently disposed in relation to one another. The chamber 106 might be heated by solar or nuclear heating.

The refrigerator disclosed hereinbefore is preferably used for the cooling of samples to be studied in physics experiments or to allow or improve the operation of superconductive materials or radiation detectors.

What is claimed:

1. A refrigerator operating in a Vuilleumier cycle, characterized in that it uses at least one gas bearing (104*a*, 104*b*, 201*a*, 204*b*) for the suspension of at least one piston (4, 104, 201), and comprising:

a first cylinder (102) having a hot end and an intermediate temperature end, and displacement piston (104) sliding in the first cylinder between a first and a second position to compress and expand a quantity of gas contained in the first cylinder (102), a conduit which includes a thermal regenerator connecting the high temperature end and the intermediate temperature end of the first cylinder;

a second cylinder (202) having an intermediate temperature end and a cold end, a second displacement piston (204) sliding in the second cylinder (202) between a first and a second position to compress and expand a quantity of gas contained in the second cylinder;

a duct connecting the intermediate temperature end of the first cylinder and the intermediate temperature end of the second cylinder;

means for displacing the first cylinder (102) and the second cylinder (202) in phase relation, characterized in that it comprises:

a gas bearing (104*a*) at the hot end of the first piston (104) and a gas bearing (104*b*) at the intermediate temperature end of the first piston;

a gas bearing (204*b*) at the intermediate temperature end of the second piston (204) and a gas bearing (204*a*) at the cold end of the second piston.

2. A refrigerator according to claim 1, characterized in that it comprises two pistons so operating in phase opposition as to minimize vibrations.

3. A refrigerator according to claim 1, characterized in that at least one series of magnets is disposed along the upper generatrix of the first cylinder (2, 102), such series of magnets having a length greater than the distance (c) between the first and second positions of the first piston (4, 104), a permanent magnet (14) being mounted on the first cylinder (2, 102) opposite each of the series of magnets, and at least one series of magnets is disposed along the upper generatrix of the second cylinder (2, 202), such series of magnets having a length greater than the distance between the first and second positions of the second piston (4, 204) of the second cylinder, a magnet (14, 214) being mounted on the second cylinder (202) opposite each of the series of magnets of the second cylinder.

4. A refrigerator according to claim 1, characterized in that at least one of the gas bearings of the first displacement piston (4, 104) and of the second displacement piston (4, 204) is formed by two frustrums (20, 22) opposed at their bases and separated by a cylindrical portion (24) (FIG. 3).

5. A refrigerator according to claim 4, characterized in that the means for rotatably driving the piston (4) are formed by three coils (40) disposed on the cylinder 120° from one another and each connected to a phase of a triple-phase electric current to form a rotary field motor (42) and a magnet (44) mounted on the piston (4), the rotary field (42) driving the magnet (44) in synchronous rotation, or a ferromagnetic material mounted on the piston, the rotary field driving the piston (4).

6. A refrigerator according to claim 5 comprising means for driving piston (80) in alternating translation are constituted by a magnet (83) mounted on piston (80) and by a magnetic ramp (94*a*,94*b*,94*c*), which is closed on itself and placed around said piston (80) and which has an inclination with respect to the axial longitudinal direction of piston (80), said magnet (83) following the magnetic ramp (94*a*,94*b*,94*c*) so as to impart an alternating translational movement to piston (80).

7. A refrigerator according to claim 6, characterized in that it has two magnetized rings (92,93) respectively placed at each of the ends of the alternating translational travel of magnet (82) mounted on piston (80).

8. A refrigerator according to claim 6, characterized in that the magnetic ramp (93*a*) is in the form of an elliptical ring inclined on the longitudinal axis of piston (80).

9. A refrigerator according to claim 6, characterized in that the magnetic ramp (94*b*) is shaped like a multiple spiral with alternating pitches.

10. A refrigerator according to claim 6, characterized in that the magnetic ramp (94*c*) has a shape with several undulations per revolution.

11. A refrigerator according to claim 4 characterized in that the means for rotatably driving the piston (4) are formed by a stepping motor (FIG. 7).

12. A refrigerator according to claim 4, characterized in that the means for rotatably driving the piston (4) are formed by at least one groove (60) bounding a circular chamber, and a helical groove (62) connecting the groove (60) to one of the chambers (6,8), a valve (64,66), preventing the cycle fluid from flowing directly from the chamber (6,8) to the groove (60) during the compression phase of the fluid, which then passes via a shunt duct (68) (FIGS. 8*a*,8*b*).

13. A refrigerator according to claim 1 characterized in that it comprises means for rotatably driving at least one of the first and second displacement pistons (4, 104, 204), the rotation of such piston causing the occurrence of a wedge of gas which is formed between the external peripheral wall of the piston (4, 104, 204) and the internal wall (34) of the cylinder (2, 102, 202), the wedge of gas forming a gas bearing (FIG. 4).

14. A refrigerator according to claim 13, characterized in that the piston (4) comprises a plurality of surfaces (32) having an inclination in relation to the internal peripheral surface (34) of the cylinder (FIG. 5*a*).

15. A refrigerator according to claim 13, characterized in that the internal wall of the cylinder (2) comprises a plurality of surfaces having an inclination in relation to the external surface of the piston (4) (FIG. 5*b*).

* * * * *